US009274480B1

(12) United States Patent
Wynn

(10) Patent No.: US 9,274,480 B1
(45) Date of Patent: Mar. 1, 2016

(54) PAPER TRAY SIZE SENSING MECHANISM

(71) Applicant: Xerox Corporation, Norwalk, CT (US)

(72) Inventor: Leslie Wynn, Letchworth Garden (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/504,519

(22) Filed: Oct. 2, 2014

(51) Int. Cl.

| | |
|---|---|
| ***G03G 15/00*** | (2006.01) |
| ***B65H 1/04*** | (2006.01) |
| ***B65H 7/20*** | (2006.01) |
| ***B65H 7/02*** | (2006.01) |
| ***B65H 9/00*** | (2006.01) |

(52) U.S. Cl.
CPC ..... *G03G 15/5029* (2013.01); *B65H 1/04* (2013.01); *B65H 7/02* (2013.01); *B65H 7/20* (2013.01); *B65H 9/00* (2013.01)

(58) Field of Classification Search
None
See application file for complete search history.

(56) References Cited

U.S. PATENT DOCUMENTS 3,847,391 A * 11/1974 Brant ..... B65H 39/115 271/220
4,014,015 A * 3/1977 Gundlach ..... G01D 5/12 324/207.13
4,673,279 A * 6/1987 Brown ..... G03G 15/234 355/25
4,691,113 A * 9/1987 Corvazier ..... G01F 23/0023 250/577
4,697,803 A * 10/1987 Kan ..... B65H 1/12 271/127
4,786,042 A 11/1988 Stemmle
4,999,616 A * 3/1991 Martin ..... G07B 17/00508 250/222.1
5,060,927 A * 10/1991 Sugiura ..... B65H 3/0669 271/109
6,330,999 B2 * 12/2001 Coombs ..... 270/58.08
6,722,650 B1 * 4/2004 Abbata ..... B65H 29/34 270/58.11
7,300,052 B2 * 11/2007 Tamura ..... B65H 31/34 270/58.12
8,052,134 B2 * 11/2011 Terao ..... B42C 1/12 270/58.02
9,162,841 B2 * 10/2015 Dunham ..... B65H 31/38
2004/0155395 A1 * 8/2004 Milillo ..... B65H 29/34 270/58.08
2006/0071410 A1 * 4/2006 Koie ..... B42C 1/12 271/207
2008/0304948 A1 * 12/2008 Ganiere ..... B64F 1/305 414/541
2010/0270109 A1 * 10/2010 McCarthy ..... B66B 13/22 187/247
2014/0211275 A1 * 7/2014 Ohta ..... H04N 1/00519 358/482
2015/0246785 A1 * 9/2015 Adachi ..... G03G 15/502 271/262
2015/0284203 A1 * 10/2015 Terrero ..... B65H 9/002 271/228

FOREIGN PATENT DOCUMENTS

JP 2010091975 A * 4/2010

* cited by examiner

*Primary Examiner* — David Gray
*Assistant Examiner* — Geoffrey Evans

(57) ABSTRACT

A media supply tray includes a cable and pulley system attached to side paper guides. Movement of one side guide causes the opposing side guide to move in the opposite direction. When the side guides are moved, a flag attached to the cable moves and can be detected to provide accurate feedback to a printer regarding media size in the tray. Alternatively, a Bowden cable can be attached to the side guides for enhanced accuracy in size sensing.

8 Claims, 6 Drawing Sheets

PAPER TRAY SIZE SENSING MECHANISM

The present disclosure relates to sheet feeding mechanisms for use in printers, and more particularly, to means for alignment of sheets in media supply trays of such printers.

Media supply trays are used in printers, such as ink jet or electrostatographic printers to support and align media for feeding the media to receive images thereon. Each media supply tray aligns the media in two dimensions, width and length. It is desirable that the printer accommodate different sizes of media, such as paper, transparency film, etc. Examples of media with different dimensions include: "A" size, 8.5 inch×11.5 inch, commonly referred to as U.S. letter size; "A4" size, 210 mm×297 mm, commonly referred to as international letter size; and 8.5 inch×14 inch, commonly referred to as legal size.

Ensuring that the width and length dimensions of the media are correctly aligned in the media supply tray is of utmost importance. Lack of proper alignment can prevent the paper from being fed into the printer feed mechanism or cause the media to be fed in a skewed orientation. This skew, in turn, can lead to either a jam in the feed mechanism or a distorted printed page. Several methods have been used by printer manufacturers to address the problem of making the media supply tray to different sizes of media. In one approach, a unique try is designated for each paper size that the printer accommodates. This will insure that the right size of media is placed into a given tray. However, this approach has the disadvantage of increased cost to the manufacturer, as well as, the disadvantage of increased cost in maintaining inventory of multiple trays not presently in use. A disadvantages to the user with this approach is that several trays will have to be stored when not in use and the trays must be interchanges when different size media is required for specific jobs.

A different approach to addressing the problem of making supply trays accommodate multiple sized media into a printer is shown in U.S. Pat. No. 4,786,042 where an adjustable sheet cassette for use in a printer is shown that includes a sheet stack support platform capable of supporting stacks of sheets of a plurality of length and width dimensions, sheet and width dimensions representing members on the cassette, each independently movable to a plurality of positions representing a plurality of sheet width and length dimensions which are automatically positioned to represent the sheet width and length dimensions of the stack of sheets, but works well for cassettes, as oppose to, copy sheet trays. Another approach is shown in prior art FIG. 1 where multiple gears and levers are used to translate a slider position to the moving carriage that holds the connector fingers that in turn move along tracks on a printed circuit board (not shown). However, this mechanism is expensive and introduces error into the sensing due to the tolerances build up and 'stop' in the mechanism.

Therefore, there is still a need for a media supply tray that is easily adjustable to accommodate multiple width and length dimensions of media and correctly aligned the media in the media supply tray.

BRIEF SUMMARY

In answer thereto, provided hereinafter is a media supply tray for use in a machine that includes a cable and pulley system attached to side paper guides. Movement of one side guide causes the opposing side guide to move in the opposite direction. When the side guides are moved, a flag attached to the cable moves and can be detected to provide accurate feedback to a printer regarding media size in the tray. Alternatively, a Bowden cable can be attached to the side guides for enhanced accuracy in size sensing by moving flags that contact printed circuit tracks in the machine.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some components are known per se' in other apparatus or applications, which may be additionally or alternatively used herein, including those from art cited herein. The cited reference, and its references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
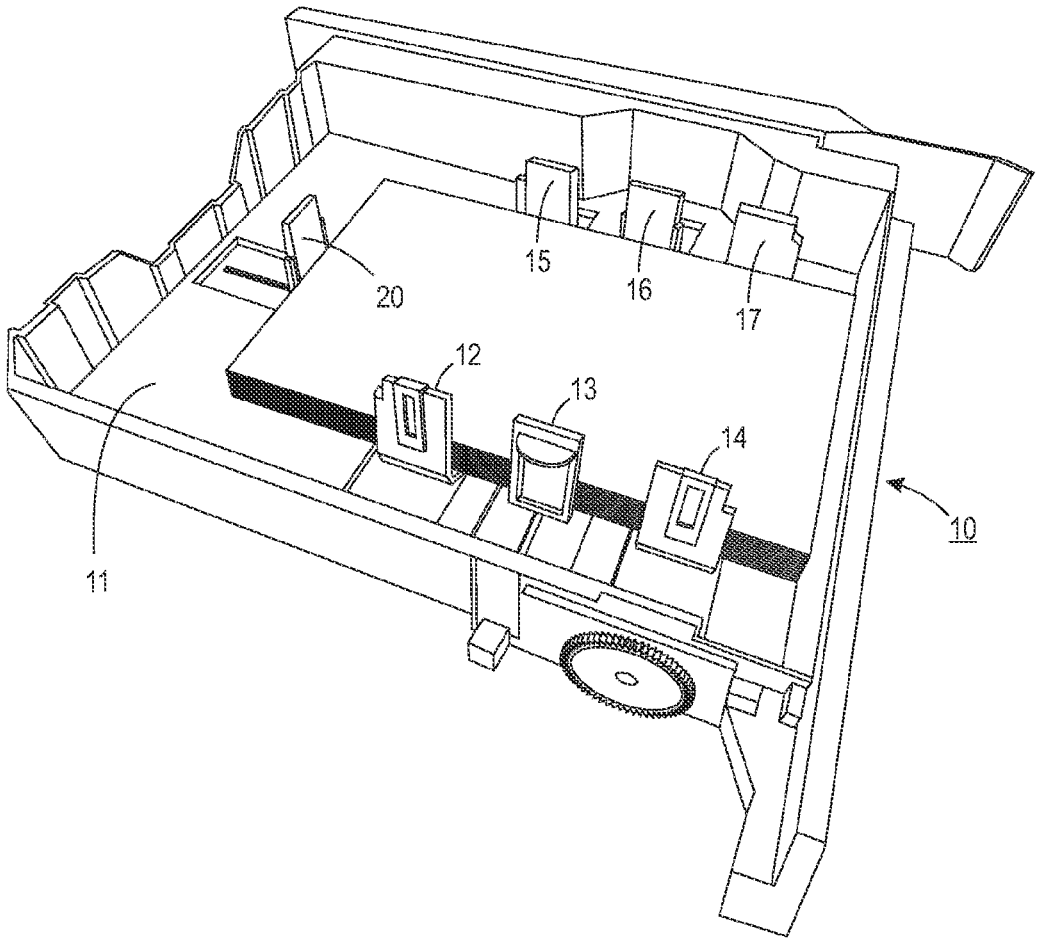
FIG. 1 PRIOR ART
FIG. 1 is a partial perspective plan view of a prior art paper tray with a sheet stack therein.
Figure 2:
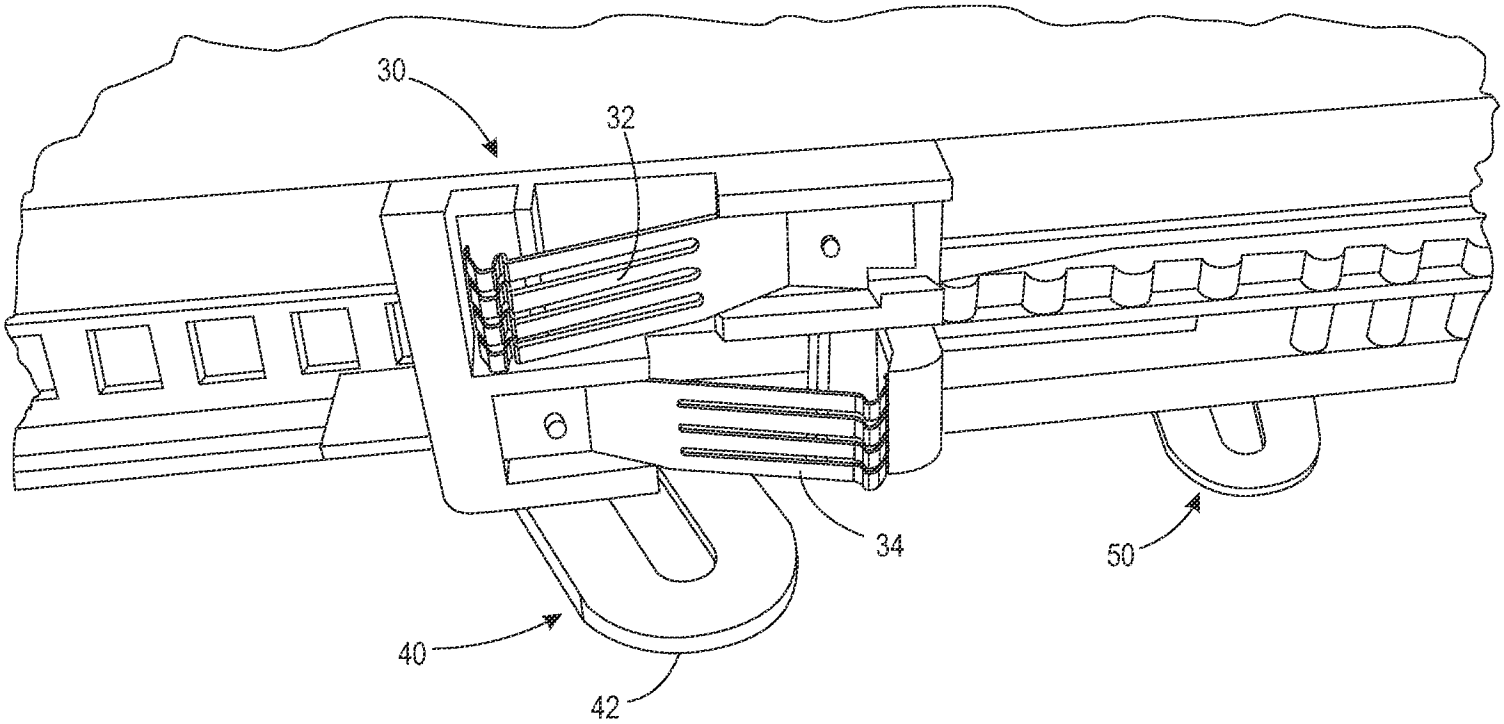
FIG. 2 PRIOR ART
FIG. 2 is a partial perspective side view of the paper tray of FIG. 1 showing flags that are moved along one side of the tray.

Referring now to prior art FIG. 1, a paper tray 10 is shown that includes a sheet support surface 11 with center registration and a set of three side walls 12, 13 and 14 on one side of the center of the tray and three side walls 15, 16 and 17 on the opposite side. The set of three side guides on each side of the tray move symmetrically according to paper width. Adjustable end guide 20 moves according to paper length and along with side guides 12, 13, 14 and 15, 16 and 17 accommodate the insertion of multiple sheet sizes into tray 10. For each paper width and length, as shown in FIG. 2, slider linkages 40 and 50, extending underneath tray 10, and more clearly shown in FIG. 3, move sprung finger connector 30 which includes spring steel flags 32 and 34 attached to an inboard end of the tray. Flags 34 and 32 bridge contacts on a conventional printer mounted common contact printed circuit board that includes a modified 3-bit Gray code (not shown). The one or two contacts connected by the flags to the common contact reflect which of six size ranges in which the paper width or length falls.

Figure 3A:
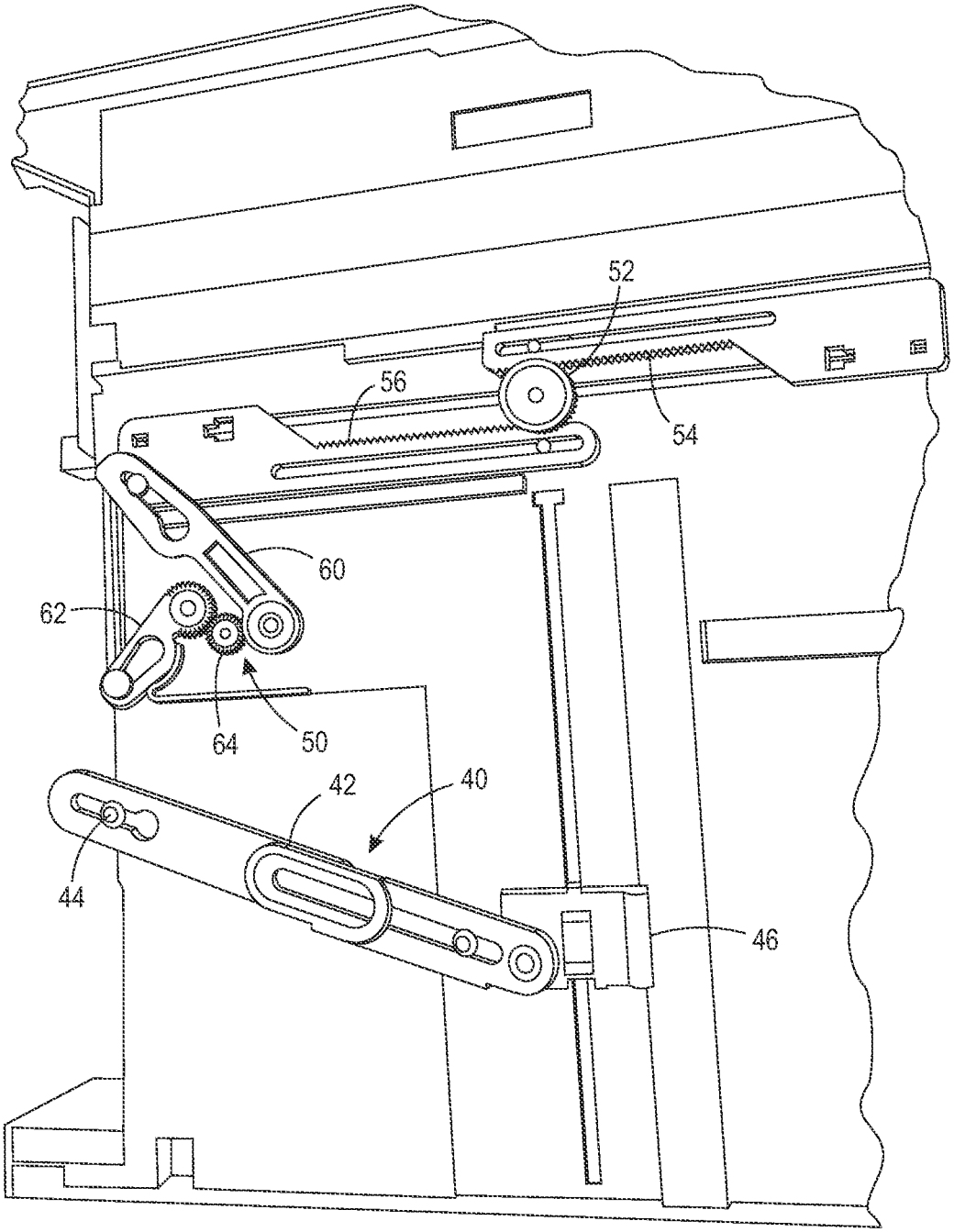
FIG. 3A PRIOR ART
FIG. 3A is a partial, schematic bottom view of the paper tray of FIG. 1 showing mechanisms for moving the flags and making side and length guide adjustments for different paper lengths and widths.
Figure 3B:
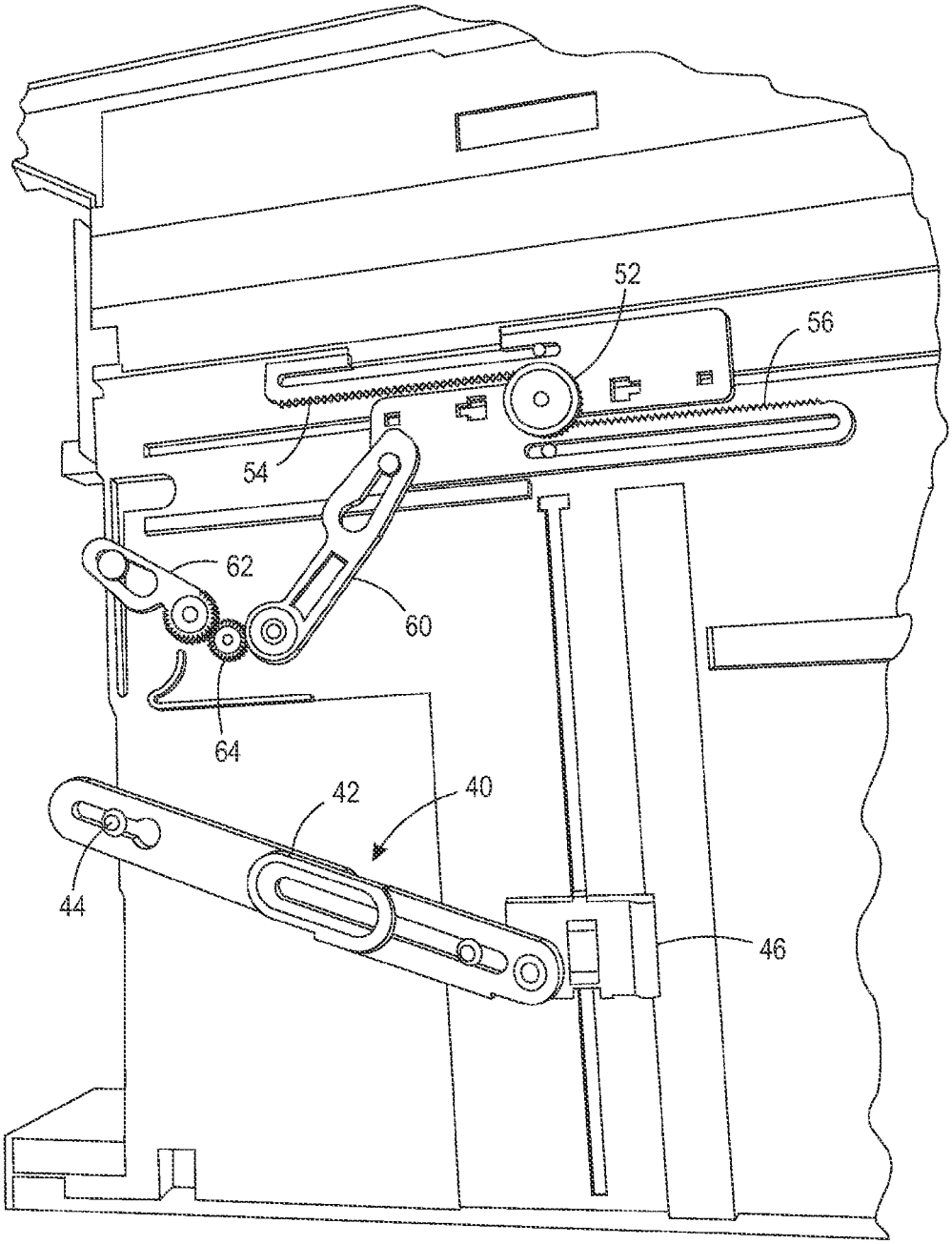
FIG. 3B PRIOR ART
FIG. 3B is a partial, schematic bottom view of the paper tray of FIG. 1 showing the position of the mechanism after having been moved for making side guide adjustments for a specific width.

In prior art FIGS. 2 and 3, slider linkages 40 and 50 are shown located on the bottom of tray 10 with linkage 40 including an arm 42 that is rotatable around a pivot member 44 and connected for movement through attachment 46 by adjustable end guide 20 shown in FIG. 1 for paper length adjustments. For paper width adjustments the two sets of side guides 12, 13, 14 and 15, 16 and 17 are moved symmetrically by way of pinion 52 and two opposed racks 54 and 56. Flags 32 and 34 are moved by two slider linkages 60 and 62 coupled by a pinion 64 and are moved simultaneously with movement of side guide sets 12, 13, 14 and 15, 16 and 17.

Figure 4:
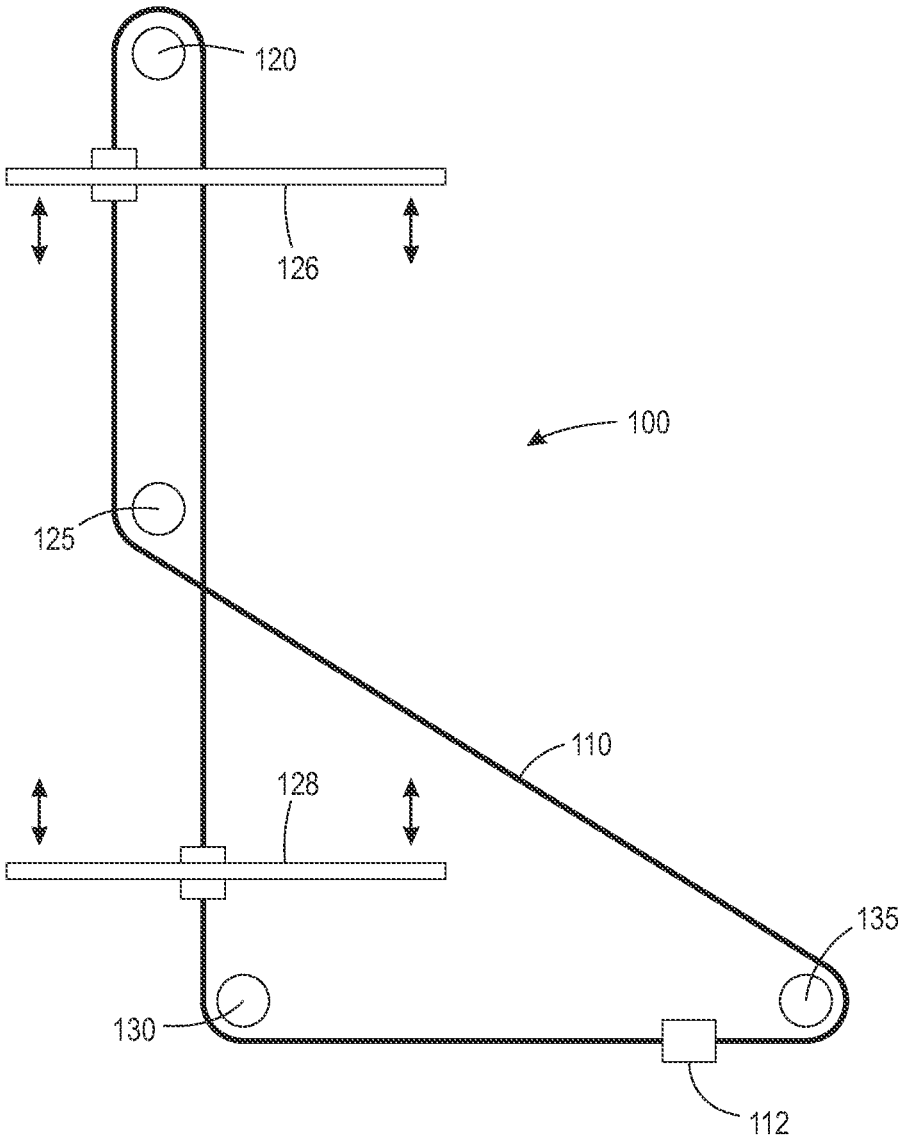
FIG. 4 is a partial, schematic plan view of the exemplary side guide adjustment mechanism in accordance with the present disclosure.

In order to improve sheet size measurement accuracy a sheet size measurement system 100 is disclosed in FIG. 4 that comprises four pulleys 120, 125, 130 and 135 and cord 110 used to center register sheets within a machine in response to movement of the sheet side guides 126 and 128 and also move the position of the size carriage. As shown, cord 110 is entrained around pulleys 120, 125, 130 and 135 and configured such that movement of side guides 126 and 128 will cause cord 110 to rotate pulleys 120, 125, 130 and 135. Flag 112 is attached to cord 110 and moved along with cord 110. Movement of metallic flag 112 triggers a conventional Gray code strip device (not shown) that signals the printer into which a tray is inserted that sheets of a specific size are located within the tray.

Figure 5:
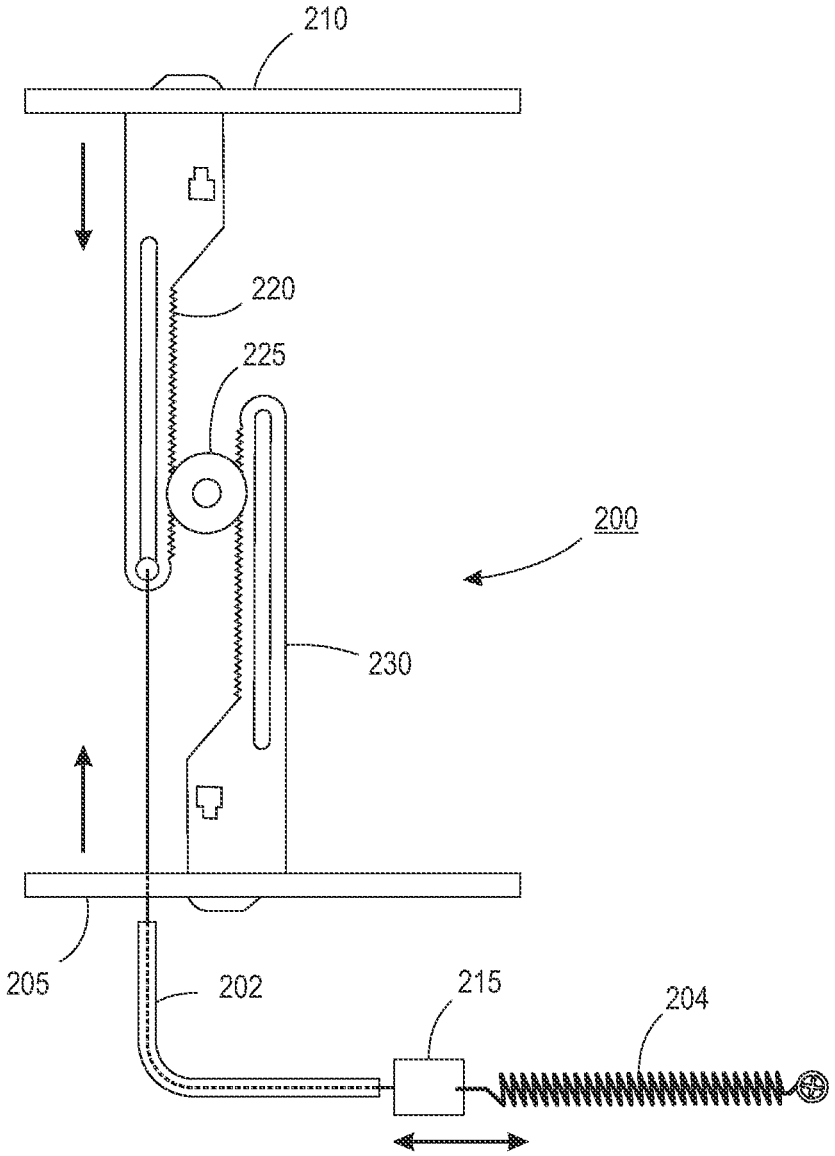
FIG. 5 is a plan view of another embodiment of an exemplary side guide adjustment mechanism in accordance with the present disclosure that includes a Bowden cable.

An alternative tray paper size sensing mechanism is shown in FIG. 5 that includes the use of a Bowden cable mechanism 200. Bowden cable mechanism 200 replaces the gear and crank arm mechanism in prior art FIG. 2 to move the paper size sprung finger connector 215. Bowden cable mechanism 200 transmits mechanical force or energy by the movement of an inner cable (most commonly of steel or stainless steel) relative to hollow outer cable housing 202. Outer cable housing 202 is generally made of composite construction consisting of a helical steel wire, often lined with nylon, and with a plastic outer sheath. Bowden cable 200 is conventionally attached to paper size sprung finger connector or flag 215 that acts on printed tracks in the machine. Flag 215 is connected to spring 204. Paper width adjustments are accomplished by movement of side guides 205 and 210 symmetrically by way of a pinion member 225 positioned between two opposed racks 220 and 230. Flag 215 is moved simultaneously with movement of side guides 205 and 210 and triggers a conventional Gray code strip device (not shown) that signals the printer the specific size of sheets that are located within the tray to which flag 215 is attached.

In recapitulation, a paper tray sheet size sensing mechanism is disclosed that includes a cable and pulley system attached to side guides. When one paper guide is moved the opposing side guide moves in the opposite direction. When the cable moves, a flag attached to the cable moves and can be detected to provide feedback to a machine regarding paper in the tray. An alternative paper tray sheet size sensing mechanism employs a Bowden cable that is moved to make adjustment for paper size by moving a paper size sprung finger connector that acts on printed tracks in the machine and includes the benefits of reduced part costs, easier assembly and enhanced accuracy in size sensing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A paper tray side guide adjustment mechanism, comprising:

a paper tray including a fixed support surface and walls surrounding said fixed support surface for holding sheets to be fed therefrom and movable side guides separate from said paper tray and adapted for adjusting to a plurality of sheet sizes within said paper tray through movement of said side guides against only sides of said plurality of sheet sizes;

a cord with said movable side guides attached to said cord;

a flag attached to said cord; and four pulleys, said cord being entrained around said four pulleys such that when one of said side guides is moved the opposing side guide moves in an opposite direction until each side guide abuts directly against opposite sides of said plurality of sheets.

2. The paper tray side guide adjustment mechanism of claim 1, wherein said cord is made of Nylon.

3. The paper tray side guide adjustment mechanism of claim 1, wherein said moveable side guides are always centered with respect to a predetermined center line.

4. A method for adjusting paper tray side guides, comprising:

providing a paper tray that includes a paper support surface surrounded by front, back and side portions;

providing movable side guides that are separate from said paper tray and adjustable to a plurality of sheet sizes and adapted to touch only sides of paper within said paper tray;

providing a cord separate from said paper tray with said movable side guides attached to said cord;

providing a flag attached to said cord; and providing four pulleys positioned beneath said movable side guides, and wherein said cord is entrained around said four pulleys such that when one of said side guides is moved the opposing side guide moves in an opposite direction until said side guides abut directly against said sides of paper within said paper tray.

5. The method of claim 4, including providing a sensor for sensing movement of said flag.

6. The method of claim 5, including providing said sensor with a plurality of metallic contact strips that represent different sheet sizes.

7. The method of claim 6, including providing said flag as a metallic member.

8. The method of claim 7, wherein movement of said side guides causes said flag to move past said plurality of metallic contact strips of said sensor, and wherein contact of said flag with one of said metallic contact strips causes a signal to be sent to a printer as to the size of sheets located within said tray.

* * * * *